United States Patent [19]

Miyashita

[11] 3,968,551

[45] July 13, 1976

[54] ADAMITE ROLL CONTAINING COBALT

[75] Inventor: Kakunosuke Miyashita, Tokyo, Japan

[73] Assignee: Hitachi Metals, Ltd., Japan

[22] Filed: June 9, 1975

[21] Appl. No.: 584,836

[30] Foreign Application Priority Data

June 12, 1974 Japan ..... 49-66103

[52] U.S. Cl. ..... 29/132

[51] Int. Cl.[2] ..... B21B 31/08

[58] Field of Search ..... 29/132, 130

[56] References Cited

UNITED STATES PATENTS 3,848,305 11/1974 Jachimiak ..... 29/132

FOREIGN PATENTS OR APPLICATIONS 14,486 4/1969 Japan ..... 29/132

*Primary Examiner*—Reinaldo P. Machado

*Attorney, Agent, or Firm*—Craig & Antonelli

[57] ABSTRACT

An steel based Adamite roll containing, in weight percent, from 1.0 to 2.2 percent C, from 0.5 to 0.8 percent Si, from 0.5 to 0.8 percent Mn, from 0.5 to 1.0 percent Ni, from 1.0 to 2.0 percent Cr, from 0.1 to 1.0 percent Mo and from 0.5 to 2.0 percent Co, and the balance being Fe. The steel based Adamite roll containing cobalt improves wear resistance and minimizes surface-roughness which are incurred to the hot rolling, and prevents defects such as surface roughness and defective dimensions of a steel rolled.

4 Claims, 8 Drawing Figures

ADAMITE ROLL CONTAINING COBALT

BACKGROUND OF THE INVENTION

This invention relates to an Steel based Adamite roll which may improve its wear resistance and minimizes its surface roughness, as well as prevents defects such as surface roughness and defective dimensions of a steel rolled.

An Steel based Adamite roll finds a wide use as an intermedite roll in a rolling mill, because of its properties which provide a compromise between those of a cast steel roll and a cast iron roll.

It is known that a roll causes the surface roughness and defective dimensions in a steel rolled due to wear and seizure in the surface of the roll, thus dictating an intermediate re-assembly or replacement of rolls, with the resulting lowering in efficiency in rolling operation.

The typical composition of an Steel based Adamite roll of the prior art is shown in Table 1. However, to meet requirements, as the case may be, such as, for the types, configurations of rolled products, there are many variations in the chemical compositions of the rolls or rolling operation, such as by increasing the content of carbon, adding Cr, Mo and Ni, modifying the processes of casting and heat treatment of the rolls, or by adjusting the cooling rate of a roll, the screw-down setting and the rolling load, thereby attaining improvements in the rolling efficiency.

Table 1

| C | Si | Mn | Ni |
|---|---|---|---|
| 1.4 to 1.7 % | 0.5 to 0.7 % | 0.5 to 0.7 % | 0.5 to 1.0 % |
| Cr | Mo | Fe | Hardness (Shore) |
| 1.2 to 1.5 % | 0.2 to 0.5 % | Balance | 45 to 50 |

As those rolls are used at an intermediate stand for about one hour, then the temperatures at the surfaces of the rolls are increased and thus the roll surfaces are covered with thin scales. This condition is most suitable for rolling.

However, the prior art Steel based Adamite roll surfaces from disadvantages in that the surface temperature of a roll is extremely raised, when rolling the steels which require a high rolling load, steels which are hard to roll, because of contents of special elements, steels of a large size and a short rolling pitch or steels requiring a high rolling temperature. Thus, in the case of a high rolling load, surface scales are peeled off, causing seizure in such portions, which seizure in turn leads to excessive wear and eventually re-assembly or replacement of the roll. In the case of section steel, as well, the pass of a roll causes surface roughness and the resulting scale peeling and seizure in the portions of the roll surfaces which are subjected to the difference in the peripheral speed, resulting in impaired surface condition of steels rolled. In addition, if a roll having a high hardness at an elevated temperature and a high tensile strength is used, there also results peeling of scales and seizure, if such a roll has a tendency to cause peeling. The surface of scales contains $Fe_3O_4$ in a small amount, while the internal portion of scales consists mostly of FeO which is soft and presents low mechanical strength. With the progress of oxidation, the amount of FeO is increased, causing internal cracking and pores, thus accelerating peeling. As a result, the more insusceptible to the oxidation, the finer the scales which are insusceptible to peeling.

SUMMARY OF THE INVENTION

It is an object of the present invention to provide an Steel based Adamite roll for use in hot rolling, which contains, in weight percent, from 1.0 to 2.2 percent C, from 0.5 to 0.8 percent Si, from 0.5 to 0.8 percent Mn, from 0.5 to 1.0 percent Ni, from 1.0 to 2.0 percent Cr, from 0.1 to 1.0 percent Mo, from 0.5 to 2.0 percent Co, the balance being essentially Fe and impurities, thereby producing scales which are fine and insusceptible to peeling in the initial stage of rolling, for the purpose of obtaining an Steel based Adamite roll which is superior in wear resistance and in surface condition which is free of roughness.

It is another object of the present invention to provide an Steel based Adamite roll which may prevent the surface roughness and defective dimensions for a hot-rolled steel and which improves efficiency in rolling operation.

DESCRIPTION OF THE PREFERRED EMBODIMENTS

Figure 1:
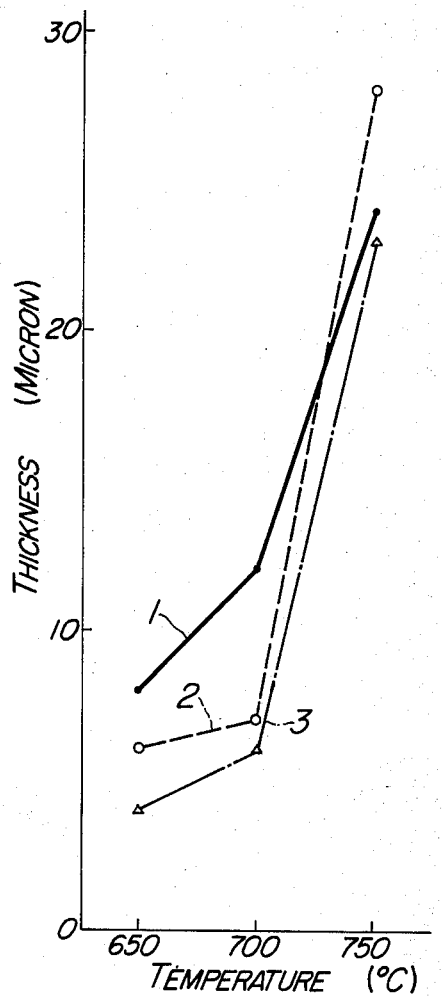
FIG. 1 is a graph showing the relationship between the content of Cr and the thickness of scale (in micron) at varying temperatures.
Figure 2:
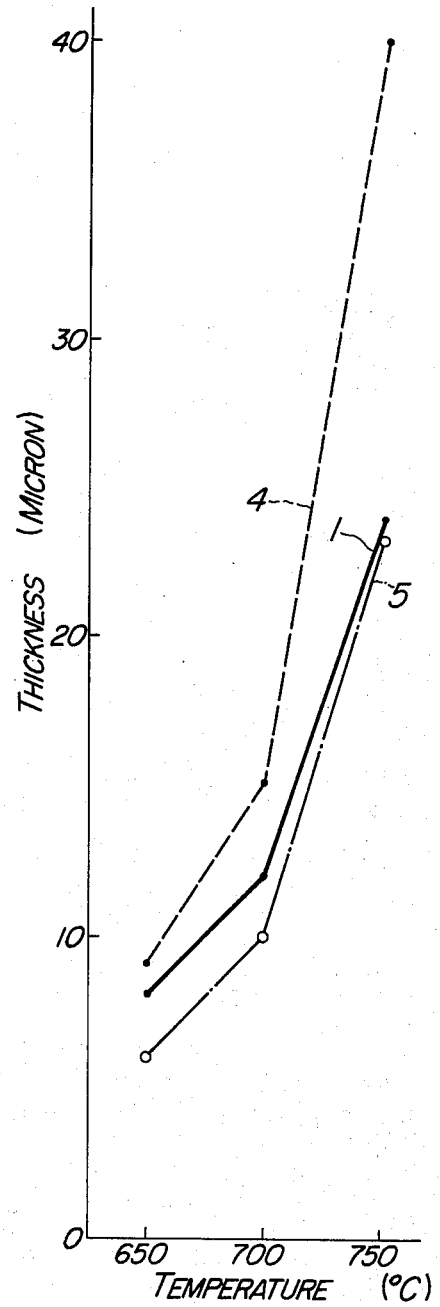
FIG. 2 is a graph showing the thickness of scales versus the contents of Cr, and Cr plus Ni and V at varying temperatures.
Figure 3:
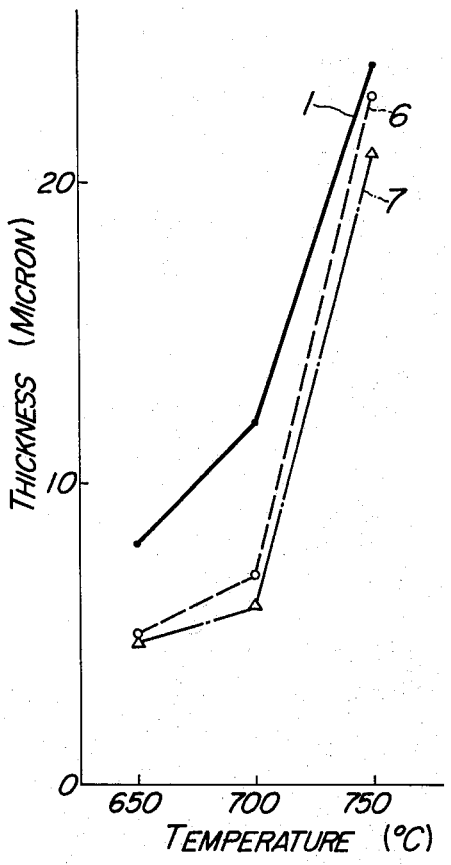
FIG. 3 is a graph showing the thickness (micron) of scales versus the contents of Cr, Cr plus Mo and Co at varying temperatures.
Figure 4:
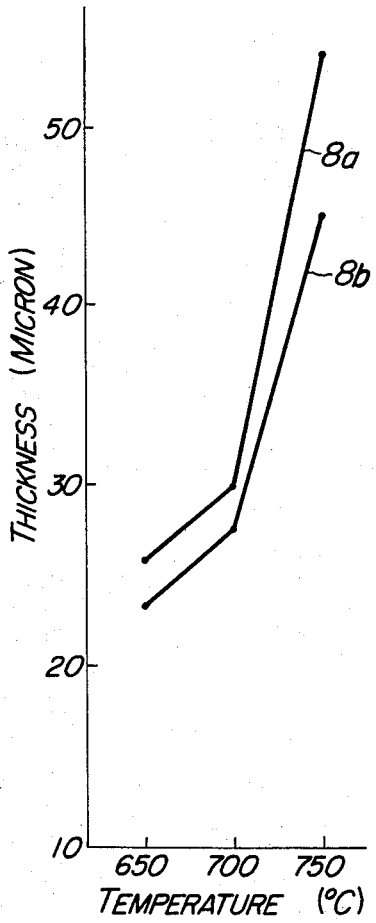
FIG. 4 is a graph showing the relationship between the contents of Cr and the thickness of scales (in micron) at varying temperatures.
Figure 5:
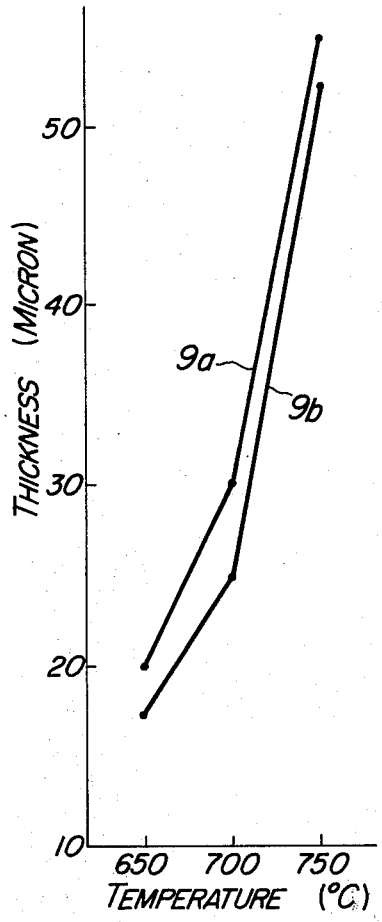
FIGS. 5, 6 and 7 are graphs showing the thickness of scales (in micron) in an Steel based Adamite roll according to the present invention, at varying temperatures.
Figure 6:
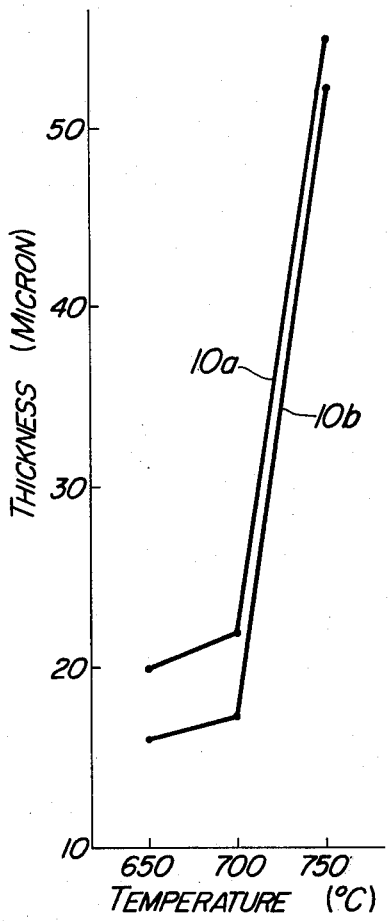
Figure 7:
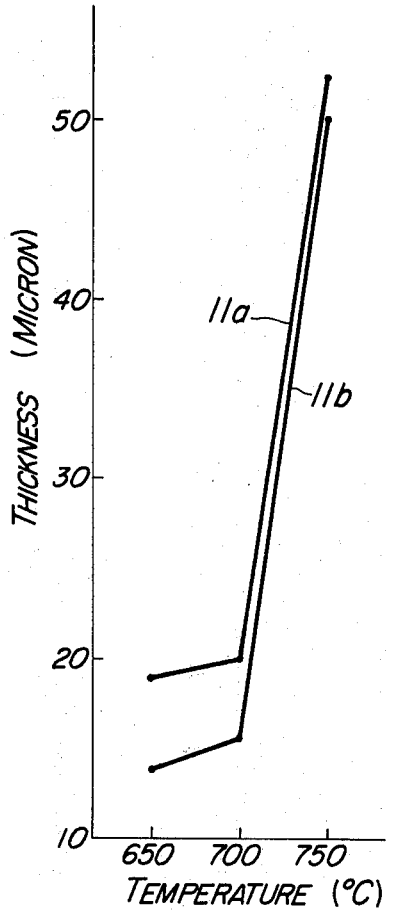
Figure 8:
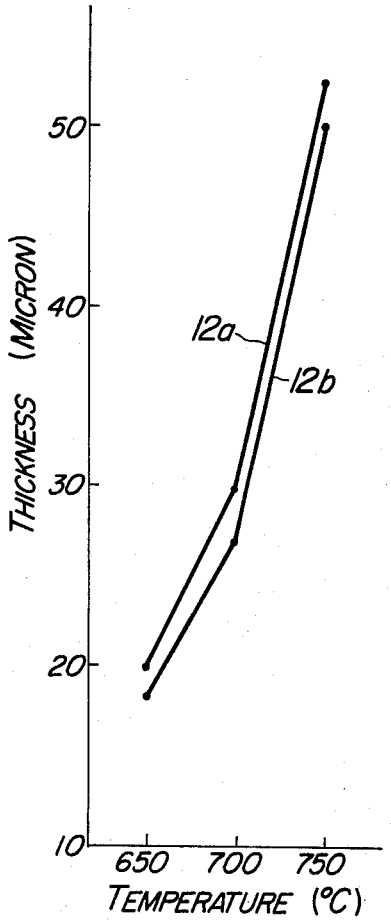
FIG. 8 is a graph showing the contents of Cr versus the thickness of scales (in micron) at varying temperatures.

Referring now to FIGS. 1, 2, and 3, there is shown the relationships between scales which are insusceptible to oxidation and fine and, as a result, free of peeling, and the chemical compositions thereof.

In FIG. 1, the content of carbon is set as a reference to 1.5 to 1.7 percent, while the content of chromium is varied. Shown at 1 is the case of 1 percent Cr, at 2 that of 2 percent Cr, and at 3 that of 3 percent Cr. In FIGS. 2 and 3, the contents of C and Cr are set as a reference to 1.5 to 1.7 percent and 1 percent, respectively. Shown at 1 therein is the case of contents as reference, at 4 is the case of addition of Ni 25 percent to the reference content, at 5 is the case of addition of 0.5 percent V to the reference content, at 6 is the case of addition of 1 percent Mo to the reference content, at 7 addition of 1 percent Co to the reference content. In either case, there are given comparisons regarding the thickness of scales when same is retained in air atmosphere for 30 minutes at temperatures of 650°, 700° and 750°C, respectively. There may be observed noticieable difference in the thickness of scales at temperatures of 650° and 700°C, while there is observed no difference accruing from the types of materials at 750°C. From viewpoints of chemical composition, the addition of Cr apparently reduces oxidation, particularly in the case of from 2 to 3 percent Cr. However, the addition of Ni enhances oxidation to a great extent. V and Mo provide effects similar to those obtained from Cr, and Co is particularly outstanding in such effects.

Table 2 shows thicknesses of scales in micron, when a roll material containing 1.5 percent C, 0.7 percent Si, 0.7 percent Mn, 0.8 percent Ni and 0.3 percent Mo, plus 1.2 percent Cr and from 0 to 1.5 percent Co or 3 percent Co alone, are maintained in air atmosphere for one hour at temperature of 650°, 700° and 750°C, respectively.

Table 2

| Chemical Composition | | Cr 1.2 % | | | | Cr 3 % |
|---|---|---|---|---|---|---|
| | | Co none | Co 0.5 % | Co 1.0 % | Co 1.5 % | Co none |
| Temp. | 650°C | 23.5 – 26 | 17.5 – 20 | 16 – 20 | 14 – 19 | 18.5 – 20 |
| | 700°C | 28 – 30 | 25 – 30 | 18.5 – 22 | 15.5 – 20 | 27 – 30 |
| | 750°C | 45 – 54 | 52.5 – 55 | 52.5 – 55 | 50 – 52.5 | 50 – 55 |

Table 2 reveals that the addition of Co in the case of 1.2 percent Cr presents resistance against oxidation similar or better than that of the case of the addition of 3 percent Cr.

FIGS. 4, 5, 6, 7 and 8 shows the figures shown in Table 2 therein, in which those shown at 8*a* and 8*b* are the case of addition of 1.2 percent Cr, at 9*a* and 9*b* the addition of 1.2 percent Cr and 0.5 percent Co, at 10*a* and 10*b* the addition of 1.2 percent Cr and 1.0 percent Co, at 11*a* and 11*b* the addition of 1.2 percent Cr and 1.5 percent Co, at 12*a* and 12*b* the addition of 3 percent Cr. The Steel based Adamite roll containing from 0.5 to 1.5 percent Co, 1.2 percent Cr and 3 percent Cr was used in hot rolling for finishing. Table 3 shows the evaluation grades and grinding rate of rolls, based on the degree of surface roughness after operation, in the first finishing stand of a hot strip mill.

Table 3

| | Acceptable | | | | Rejected |
|---|---|---|---|---|---|
| Evaluation grade | 1 | 2 | 3 | 4 | 5 |
| Grinding rate (mm) | 0.2 | 0.4 | 0.5 | 0.8 | 1.2 |

The evaluation grades of those Steel based Adamite roll were found to be 2.2 in average. However, the evaluation grade of roll, to which was added Co, was found to be 1.4 in average, while the grinding rate was reduced from 0.42 mm to 0.28 mm.

The background for the chemical compositions of rolls according to the present invention will be given, hereunder.

Carbon is required to be added in an amount of over 1.0 percent for the purposes of generating desired hardness to rolls and preventing wear. However, carbon content of over 2.2 percent tends to precipitate large carbide. Thus, the upper limit of carbon should be set to 2.2 percent. Silicon content should range from 0.5 to 0.8 percent. If the content of silicon exceeds 0.8 percent, then graphite is precipitated. The desired carbon content of the present invention should range from 1.0 to 1.2 and from 1.4 to 1.6 percent.

Like the case of Si, manganese content should fall in the range of from 0.5 to 0.8 percent, for serving as an oxidizer. However, if the content exceeds 0.8 percent, there results embrittlement.

Nickel content is in the range of from 0.5 to 1.0 percent, for improving strength and toughness thereof. However, if the content exceeds 1.0 percent, then the resistance to oxidation is reduced.

Chromium content should range from 1.0 to 2.0 percent. The Cr content of over 1.0 is required for improving the resistance to oxidation. If the content exceeds 2.0 percent, then large size carbides are produced, thus causing embrittlement, with the accompanying noticeable surface roughness.

Molybdenum content should fall in the range of from 0.4 to 0.8 percent. For improving strength, the content of 0.1 to 1.0 percent is necessary.

Cobalt content should preferably be in the range of from 0.5 to 2.0 percent. The addition of cobalt of only 0.5 percent prevents oxidation by producing tough scales. However, if the content exceeds 2.0 percent there results no appreciable effect, so that the upper limit is set to 2.0 percent.

In addition, the addition of vanadium ranging from 0.5 to 1.5 percent exhibits preferable effect, in the present invention.

As is apparent from the foregoing description of the Steel based Adamite roll according to the present invention, the addition of cobalt produces fine scales on the surface of the roll, thus improving resistance to oxidation as well as peeling of the scales. This in turn improves wear resistance and surface condition which is free of roughness, with the accompanying advantages of prevention of defective dimensions of steel rolled and improved efficiency in rolling operation.

What is claimed is:

1. An Steel based Adamite roll containing, in weight percent, from 1.0 to 2.2 percent C, from 0.5 to 0.8 percent Si, from 0.5 to 0.8 percent Mn, from 0.5 to 1.0 percent Ni, from 1.0 to 2.0 percent Cr, from 0.1 to 1.0 percent Mo, from 0.5 to 2.0 percent Co, the balance being essentially Fe, and a reasonable amount of impurities.

2. An Steel based Adamite roll containing, in weight percent, from 1.0 to 1.2 percent C, from 0.5 to 0.8 percent Si, from 0.5 to 0.8 percent Mn, from 0.5 to 1.0 percent Ni, from 1.5 to 2.0 percent Cr, from 0.4 to 0.8 percent Mo, from 0.5 to 1.5 percent Co, the balance being essentially Fe, and a reasonable amount of impurities.

3. An Steel based Adamite roll containing, in weight percent, from 1.4 to 1.6 percent C, from 0.5 to 0.8 percent Si, from 0.5 to 0.8 percent Mn, from 0.5 to 1.0 percent Ni, from 1.0 to 2.0 percent Cr, from 0.4 to 0.8 percent Mo, from 0.5 to 1.5 percent Co, the balance being essentially Fe, and a reasonable amount of impurities.

4. An Steel based Adamite roll containing, in weight percent, from 1.0 to 2.2 percent C, from 0.5 to 0.8 percent Si, from 0.5 to 0.8 percent Mn, from 0.5 to 1.0 percent Ni, from 1.0 to 2.0 percent Cr, from 0.1 to 1.0 percent Mo, from 0.5 to 1.5 percent V, from 0.5 to 2.0 percent Co, the balance being essentially Fe, and a reasonable amount of impurities.

* * * * *